US010939210B2

(12) United States Patent
Chang et al.

(10) Patent No.: US 10,939,210 B2
(45) Date of Patent: Mar. 2, 2021

(54) VIBRATION SYSTEM, LOUDSPEAKER, AND METHOD FOR MANUFACTURING THE VIBRATION SYSTEM

(71) Applicant: HONG FU JIN PRECISION INDUSTRY (ShenZhen) CO., LTD., Shenzhen (CN)

(72) Inventors: Kai-Ping Chang, New Taipei (TW); Shou-Fang Zhong, Shenzhen (CN); Peng-Shuai Guo, Guangdong (CN)

(73) Assignee: HONG FU JIN PRECISION INDUSTRY (ShenZhen) CO., LTD., Shenzhen (CN)

( * ) Notice: Subject to any disclaimer, the term of this patent is extended or adjusted under 35 U.S.C. 154(b) by 0 days.

(21) Appl. No.: 16/423,587

(22) Filed: May 28, 2019

(65) Prior Publication Data

US 2020/0329313 A1 Oct. 15, 2020

(30) Foreign Application Priority Data

Apr. 10, 2019 (CN) ..... 201910283085.1

(51) Int. Cl.

| | |
|---|---|
| ***H04R 9/00*** | (2006.01) |
| ***H04R 7/00*** | (2006.01) |
| ***H04R 9/02*** | (2006.01) |
| ***H04R 1/02*** | (2006.01) |
| ***H04R 7/06*** | (2006.01) |

(52) U.S. Cl.

CPC ..... *H04R 9/025* (2013.01); *H04R 1/025* (2013.01); *H04R 7/06* (2013.01)

(58) Field of Classification Search

CPC .... H04R 9/00; H04R 29/003; H04R 2209/00; H04R 2209/41; H04R 7/00; H04R 2207/00

USPC ..... 381/396, 398, 404, 407, 423

See application file for complete search history.

(56) References Cited

U.S. PATENT DOCUMENTS

| | | | | | |
|---|---|---|---|---|---|
| 4,122,314 | A | * | 10/1978 | Matsuda | H04R 7/02 181/170 |
| 5,574,797 | A | * | 11/1996 | Geisenberger | H04R 7/20 381/398 |
| 6,088,466 | A | * | 7/2000 | Proni | H04R 9/02 381/397 |
| 6,160,898 | A | * | 12/2000 | Bachmann | H04R 7/045 381/398 |

* cited by examiner

*Primary Examiner* — Suhan Ni
(74) *Attorney, Agent, or Firm* — ScienBiziP, P.C.

(57) ABSTRACT

A vibration system which does not rely on adhesive assembly includes a first bracket and a vibration assembly. The vibration assembly includes a voice coil portion and a first diaphragm portion. The voice coil portion includes a mounting base and a voice coil body. The voice coil body surrounds an outer surface of the mounting base. Through holes define in one end of the mounting base. The through holes penetrate the base. The first diaphragm portion includes two connecting portions and a diaphragm body between the two connecting portions. A first connecting portion connects the first bracket. A second connecting portion surrounds an end of the mounting base away from the voice coil body, and the second connecting portion inserts into the through hole. The disclosure further provides a loudspeaker and a method for manufacturing the vibration system.

14 Claims, 11 Drawing Sheets

VIBRATION SYSTEM, LOUDSPEAKER, AND METHOD FOR MANUFACTURING THE VIBRATION SYSTEM

FIELD

The disclosure generally relates to a vibration system, a speaker and a method for manufacturing the vibration system.

BACKGROUND

Loudspeakers usually have vibration systems for generating sound. The vibration system is a main component of the loudspeaker. The quality/design/material of the vibration system largely determines the sound of the loudspeaker. The vibration system may have various vibration components, which may be connected to each other by adhesive. However, the non-uniformity of the adhesive in thickness may cause imprecise relationships between the vibration components, which affects the acoustic performance of the loudspeaker. Therefore, there is room for improvement in the art.

BRIEF DESCRIPTION OF THE DRAWINGS

Implementations of the present disclosure will now be described, by way of embodiments, with reference to the attached figures.

DETAILED DESCRIPTION

Figure 1:
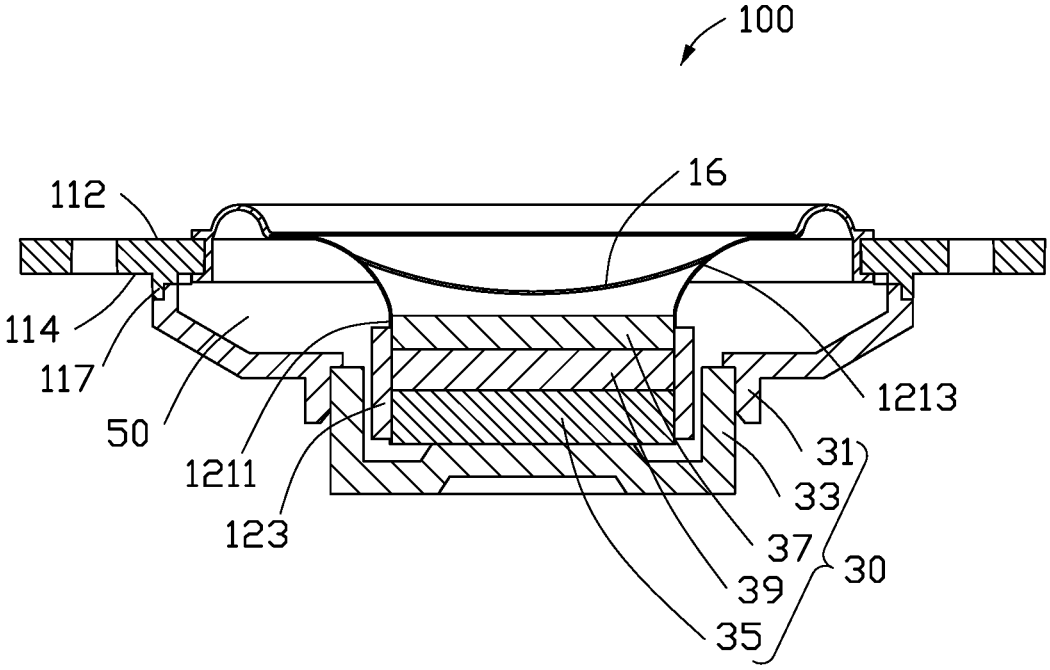
FIG. 1 is a cross-sectional view of an embodiment of a loudspeaker.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiment described herein can be practiced without these specific details. In other instances, methods, procedures, and components have not been described in detail so as not to obscure the related relevant feature being described. Further, the description is not to be considered as limiting the scope of the embodiments described herein. The drawings are not necessarily to scale and the proportions of certain parts may be exaggerated to better illustrate details and features of the present disclosure.

The term "comprising" when utilized, means "include, but is not limited to"; it specifically indicates open-ended inclusion or membership in the so-described combination, group, series and the like. The term "coupled" when utilized, means "either a direct electrical connection between the things that are connected, or an indirect connection through one or more passive or active intermediary devices, but is not limited to".

FIG. 1 illustrates an embodiment of a loudspeaker 100. The loudspeaker 100 can be utilized in an electronic device (not shown). The electronic device can be, but is not limited to, a speaker, a mobile phone, a tablet computer, and an earphone.

Figure 2:
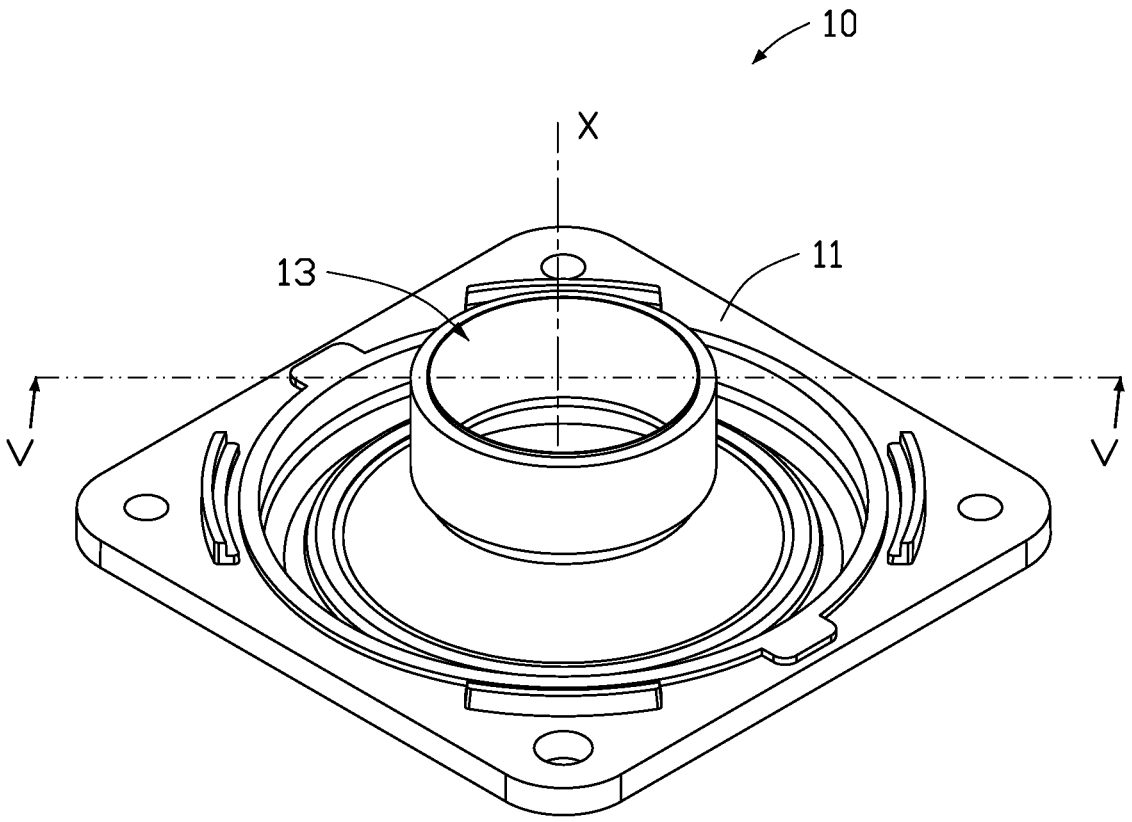
FIG. 2 is an isometric view of a vibration system of the loudspeaker of FIG. 1.

Referring to FIG. 2, the speaker 100 includes a vibration system 10. In some embodiments, the vibration system 10 includes a first bracket 11 and a vibration assembly 13. The vibration assembly 13 is positioned on the first bracket 11.

Figure 3:
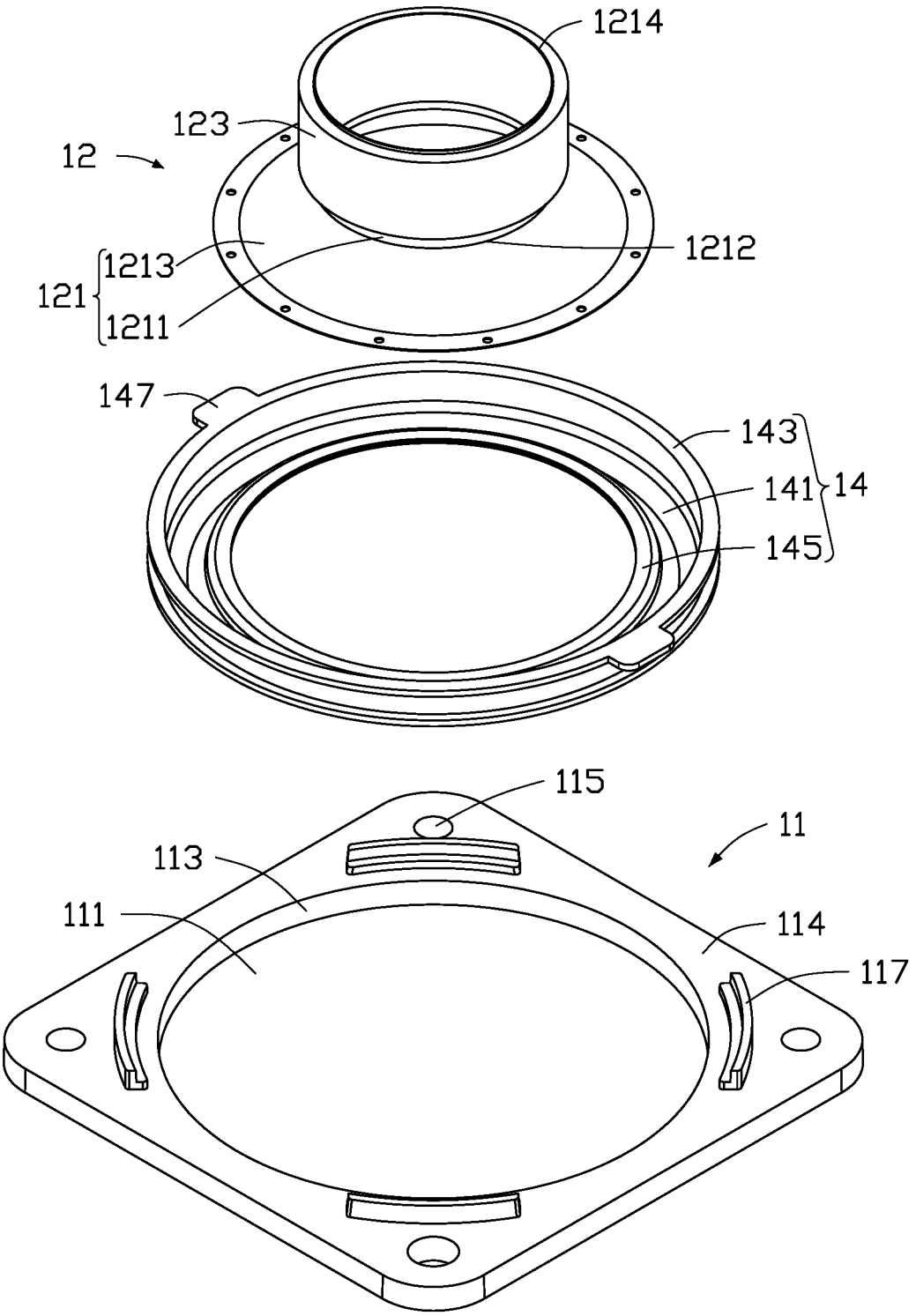
FIG. 3 is an exploded view of the vibration system in FIG. 2.
Figure 4:
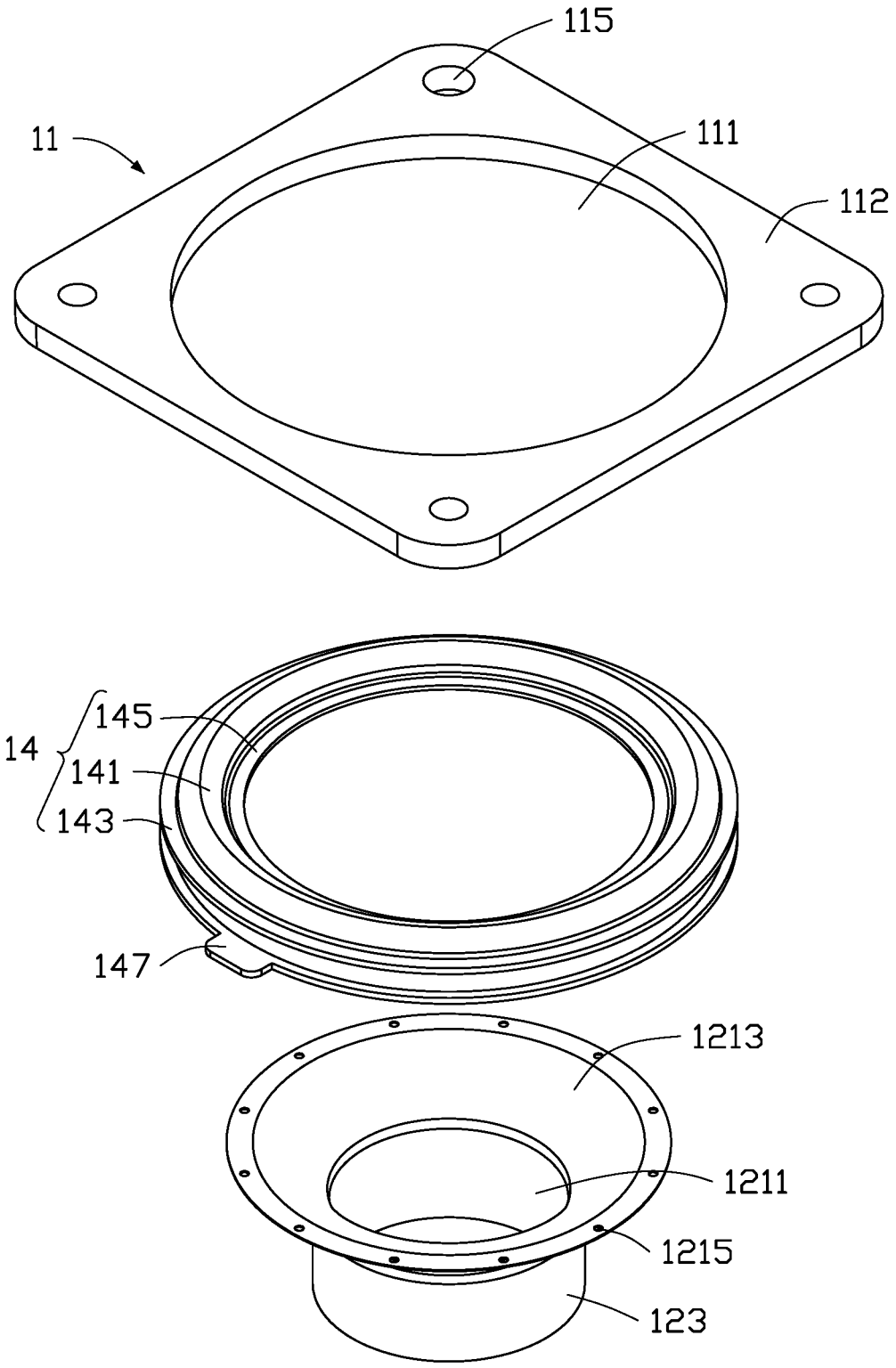
FIG. 4 is another exploded view of the vibration system in FIG. 2.

Referring to FIGS. 3 and 4, in some embodiments, the first bracket 11 includes an upper surface 112 and a lower surface 114. The upper surface 112 and the lower surface 114 are on two opposite sides of the first bracket 11. The first bracket 11 defines a hole 111 to form an inner surface 113 on the first bracket 11. The hole 111 penetrates the upper surface 112 and the lower surface 114. The first bracket 11 can be made of a material selected from plastic, metal, and combination thereof. The plastic can be, but is not limited to, ABS (Acrylonitrile Butadiene Styrene), PBT (Polybutylene Terephthalate), and PC (Polycarbonate). The metal can be, but is not limited to, aluminum, aluminum alloy, aluminum-magnesium alloy, magnesium alloy, stainless steel, titanium, and titanium alloy.

The first bracket 11 further defines at least one connecting hole 115. The connecting hole 115 is used for connecting the first bracket 11 to the electronic device. In some embodiments, the first bracket 11 defines four connecting holes 115. The four connecting holes 115 are respectively at the four corners of the first bracket 11. Each of the connection holes 115 penetrates the upper surface 112 and the lower surface 114.

Further, the first bracket 11 further includes a plurality of blocks 117 protruding from the upper surface 112 or the lower surface 114. In some embodiments, the first bracket 11 includes four blocks 117 evenly distributed along the inner surface 113. The cross-section of the block 117 is substantially L-shaped (refer to FIG. 5).

In other embodiments, the connecting hole 115 and the block 117 can be omitted from the first bracket 11.

The vibration assembly 13 is positioned in the hole 111 and connected to the first bracket 11.

The vibration assembly 13 includes a voice coil portion 12 and a first diaphragm portion 14.

The voice coil portion 12 includes a mounting base 121 and a voice coil body 123.

Figure 5:
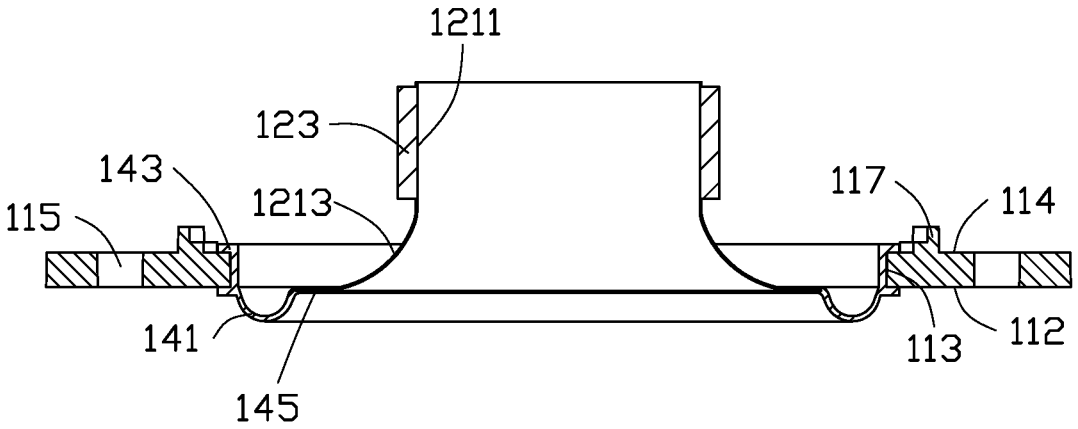
FIG. 5 is a cross sectional view taken along line V-V of FIG. 2.
Figure 6:
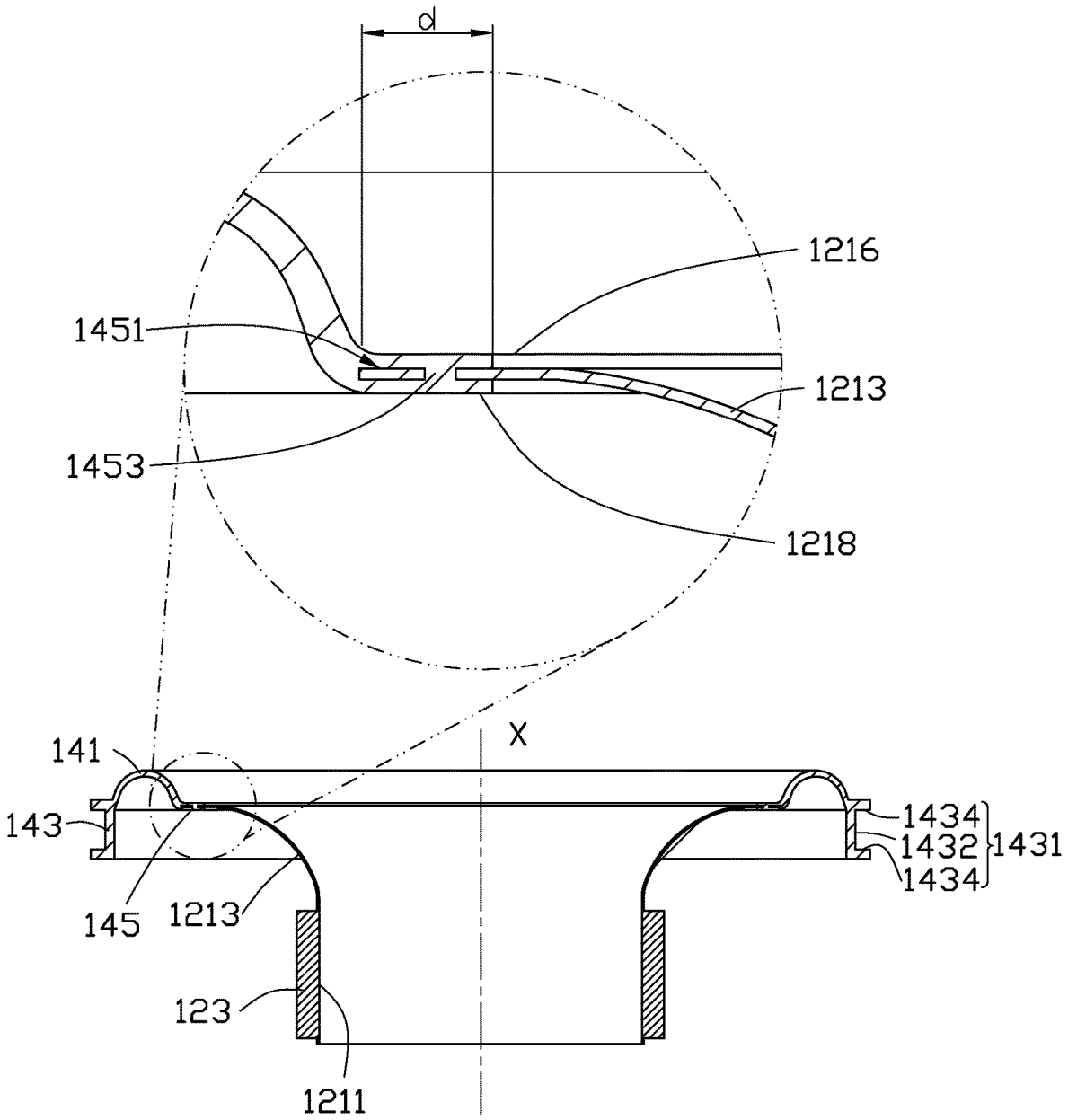
FIG. 6 is a cross sectional view of the vibration system in FIG. 5.

Referring to FIG. 5 and FIG. 6, the mounting base 121 includes a base portion 1211. The base portion 1211 is annular. In some embodiments, the base portion 1211 is a hollow cylinder. The base portion 1211 includes an upper edge 1212 and a lower edge 1214. The upper edge 1212 and the lower edge 1214 are on opposite sides of the base portion 1211.

The mounting base 121 further includes an extending portion 1213. The extending portion 1213 extends from the upper edge 1212 along a direction away from the lower edge 1214. The mounting base 121 has a central axis X. The central axis X defines the central axis of the vibration system 10. In some embodiments, the mounting base 121 is substantially trumpet-shaped or basin-shaped. The extending portion 1213 is recessed toward the central axis X.

In other embodiments, the extending portion 1213 can be recessed away from the central axis X.

In some embodiments, the base portion 1211 and the extending portion 1213 are integrally formed. The mounting base 121 can be made of aluminum.

In other embodiments, the mounting base 121 can be made of a material selected from metal, plastic, and paper. The metal can be, but is not limited to, copper, aluminum alloy, aluminum-magnesium alloy, magnesium alloy, and stainless steel. The plastic can be, but is not limited to, PI (Polyimide), and PEEK (Polyetheretherketone).

The voice coil body 123 surrounds an outer surface of the base portion 1211. In some embodiments, the voice coil body 123 is positioned at an end of the base 1211 away from the extending portion 1213. The voice coil body 123 includes a plurality of copper wires wound around the outer surface of the base portion 1211. Adhesive is filled among the copper wires to improve the connecting strengthen between the voice coil body 123 and the base portion 1211.

Referring to FIG. 5 and FIG. 6, the first diaphragm portion 14 is positioned between the first bracket 11 and the extending portion 1213. In some embodiments, the first diaphragm portion 14 is annular (see FIG. 3 and FIG. 4). The first diaphragm portion 14 includes a diaphragm body 141, a first connecting portion 143, and a second connecting portion 145. The diaphragm body 141 is positioned between the first connecting portion 143 and the second connecting portion 145. The second connecting portion 145 and the diaphragm body 141 are positioned between the first connecting portion 143 and the extending portion 1213. The first connecting portion 143 connects to the first bracket 11. The second connecting portion 145 surrounds an edge of the base portion 1211 away from the extending portion 1213. A distance (labeled as "d") between an edge of the diaphragm body 141 near the second connecting portion 145 and an edge of the extending portion 1213 connecting the second connecting portion 145 is between 0.02 mm and 0.6 mm.

The first connecting portion 143 is recessed inward to form a first groove 1431. The first groove 1431 faces the first bracket 11. A side of the first bracket 11 adjacent to the extending portion 1213 is positioned in the first groove 1431. The first groove 1431 includes a bottom wall 1432 and two sidewalls 1434. The two sidewalls face each other. Two sidewalls 1434 are respectively at two sides of the bottom wall 1432. The inner surface 113 of the first bracket 11 abuts against the bottom wall 1432 of the first groove 1431, and the upper surface 112 and the lower surface 114 of the first bracket 11 respectively abut against two sidewalls 1434.

In one embodiment, the second connecting portion 145 is positioned at an upper side surface 1216 or a lower side surface 1218 of an edge of extending portion 1213 away from the base portion 1211.

In some embodiments, the second connecting portion 145 is recessed inwardly to form a second groove 1451. The second groove 1451 faces the voice coil portion 12. An edge of the extending portion 1213 away from the base portion 1211 is positioned in the second groove 1451.

Figure 9:
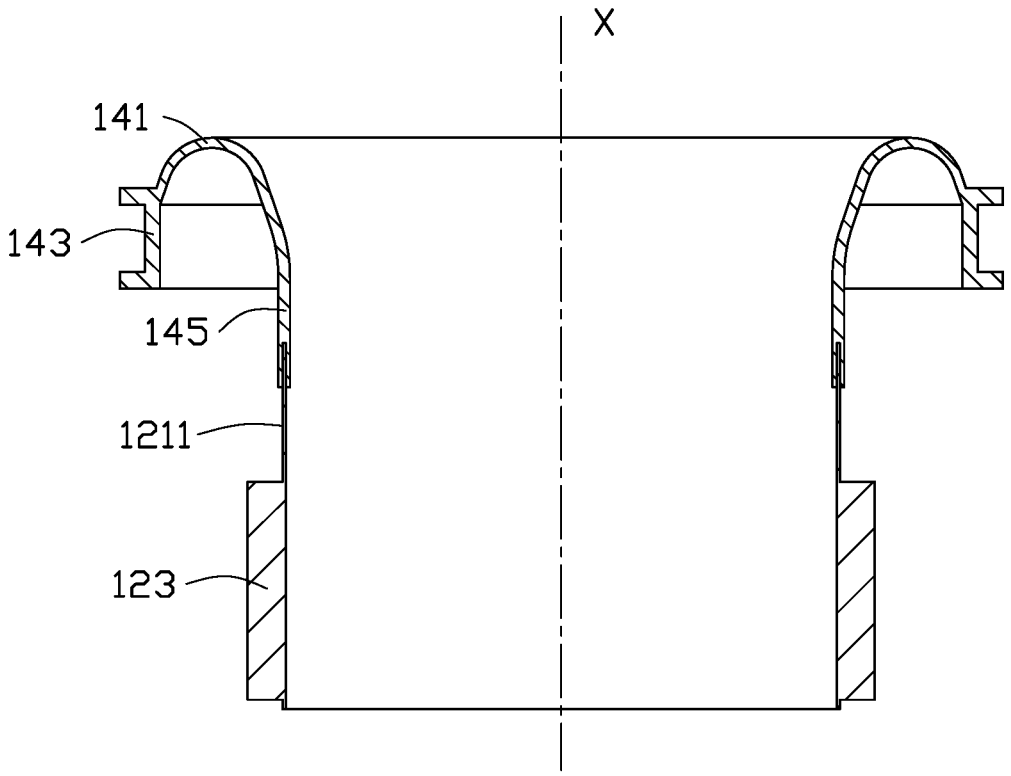
FIG. 9 is a cross sectional view of a fourth embodiment of a vibration system.

Referring to FIG. 9, in other embodiments, the mounting base 121 only includes the base portion 1211. As such, an edge of the base portion 1211 away from the voice coil body 123 is positioned in the second groove 1451.

Further, pillars 1453 (refer to FIG. 6) are positioned in the second groove 1451. Correspondingly, an edge of the extending portion 1213 away from the base portion 1211 defines through holes 1215 (referring to FIG. 3 and FIG. 4). The through holes 1215 are evenly distributed around an edge of the extending portion 1213 away from the base portion 1211. As such, when the edge of the extending portion 1213 away from the base portion 1211 is positioned in the second groove 1451, the pillars 1453 are positioned in the through holes 1215 to reinforce the connection between the voice coil portion 12 and the first diaphragm portion 14. This arrangement holds the voice coil portion 12 in place.

In some embodiments, the first diaphragm portion 14 can be made of liquid silicone rubber. The first diaphragm portion 14 is connected between the first bracket 11 and the extending portion 1213 by injection molding process.

Further, a lug 147 protrudes from a surface of the first connecting portion 143 away from the second connecting portion 145 (refer to FIG. 3 and FIG. 4). When the first diaphragm portion 14 is positioned between the first bracket 11 and the extending portion 1213, the lug 147 is positioned on the lower surface 114 of the first bracket 11 and reinforces the connection between the vibration portion 14 and the first bracket 11.

Different embodiments of the vibration assemblies 13 are described.

Embodiment 1

Referring to FIGS. 4, 5, and 6, the vibration assembly 13 includes a voice coil portion 12 and a first diaphragm portion 14. The voice coil portion 12 includes a mounting base 121 and a voice coil body 123. The mounting base 121 includes a base portion 1211 and an extending portion 1213. The base portion 1211 is a hollow cylinder. The base portion 1211 includes an upper edge 1212 and a lower edge 1214. The upper edge 1212 and the lower edge 1214 are on opposite sides of the base portion 1211. The extending portion 1213 extends from the upper edge 1212 along a direction away from the lower edge 1214. The extending portion 1213 is recessed toward the central axis X. The voice coil body 123 surrounds an outer surface of the base portion 1211.

The first diaphragm portion 14 includes a diaphragm body 141, a first connecting portion 143, and a second connecting portion 145. The first connecting portion 143 and the second connecting portion 145 are on one horizontal plane. The horizontal plane is perpendicular to the central axis X. The diaphragm body 141 is positioned between the first connecting portion 143 and the second connecting portion 145. The second connecting portion 145 and the diaphragm body 141 are positioned between the first connecting portion 143 and the extending portion 1213. The first connecting portion 143 is recessed inwards to form a first groove 1431. The first groove 1431 faces away from the voice coil portion 12. The second connecting portion 145 is recessed inwards to form a second groove 1451. The second groove 145 faces the voice coil portion 12. An edge of the extending portion 1213 away from the base portion 1211 is positioned in the second groove 1451. The cross-section of the diaphragm body 141 is arched. The diaphragm body 141 is a convex shape relative to an edge of the extending portion 1213 close to the diaphragm body 141.

Embodiment 2

Figure 7:
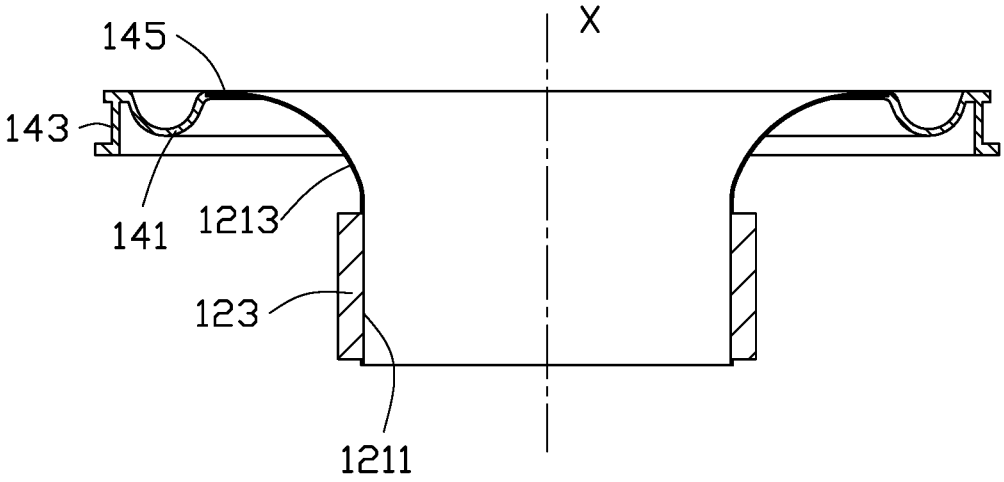
FIG. 7 is a cross sectional view of a second embodiment of a vibration system.

Referring to FIG. 7, the difference between Embodiment 2 and Embodiment 1 is that although the cross-section of the diaphragm body 141 is also arched in Embodiment 2, the diaphragm body 141 in Embodiment 2 is a concave shape relative to an edge of the extending portion 1213 close to the diaphragm body 141.

Embodiment 3

Figure 8:
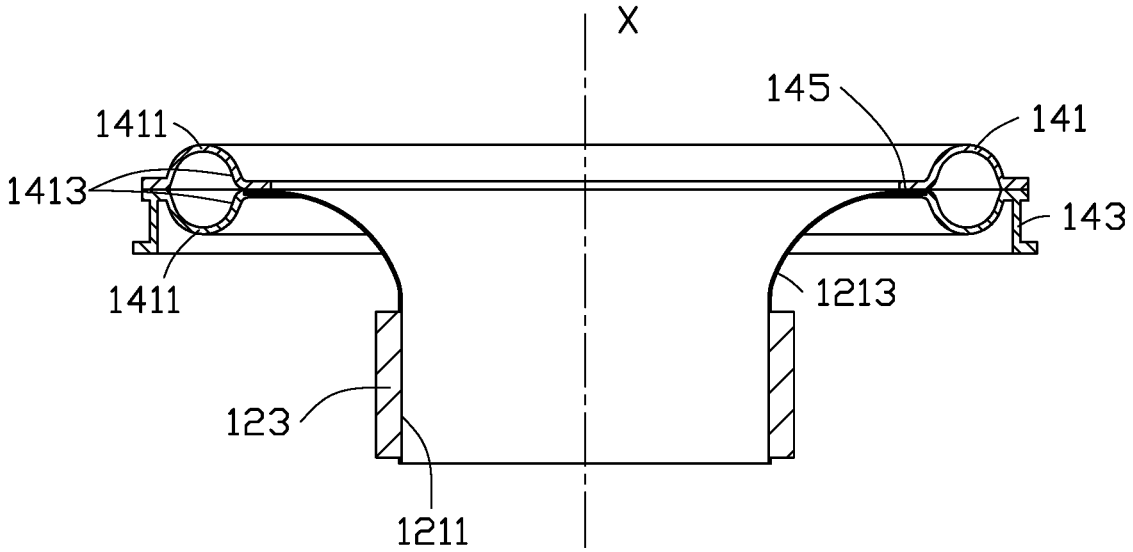
FIG. 8 is a cross sectional view of a third embodiment of a vibration system.

Referring to FIG. 8, the difference between Embodiment 3 and Embodiment 1 is that the cross-section of the diaphragm body 141 in Embodiment 3 is substantially circular. That is, the diaphragm body 141 includes two curved portions 1411. The two curved portions 1411 face each other. Each of the two curved portions 1411 connects between the first connecting portion 143 and the second connecting portion 145. Each of the two curved portions 1411 has a concave surface 1413. Concave surfaces 1413 of the two curved portions 1411 face each other to form the diaphragm body 141 having a substantially circular cross-section.

Embodiment 4

Referring to FIG. 9, the difference between Embodiment 4 and Embodiment 1 is that the mounting base 121 in Embodiment 4 only includes the base portion 1211. As such, the upper edge 1212 of the base portion 1211 is received in the second groove 1451.

Embodiment 5

Figure 10:
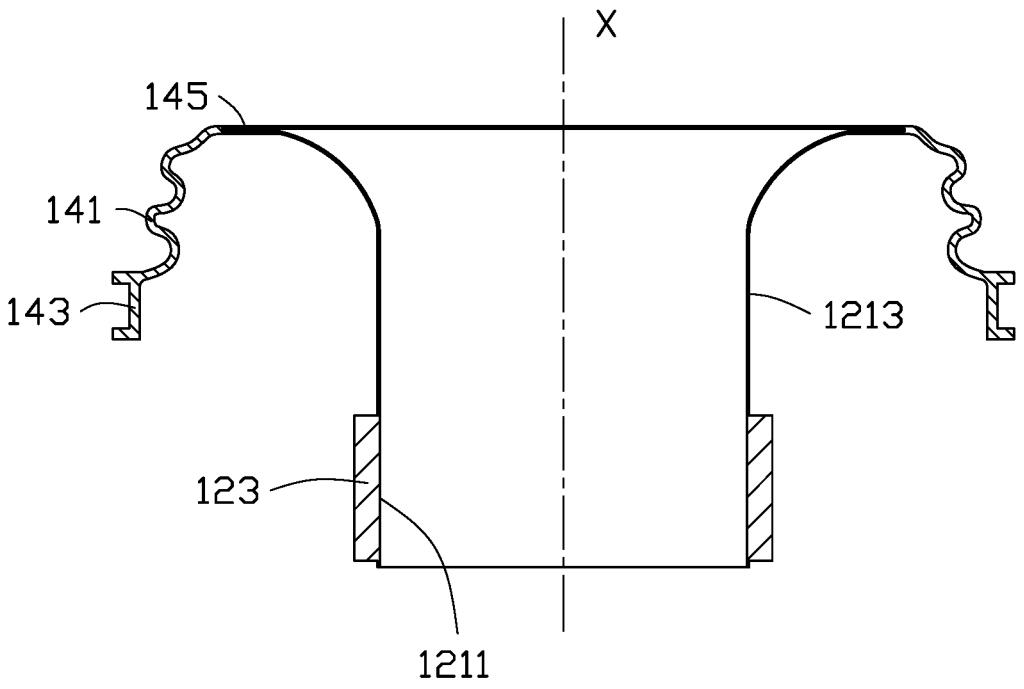
FIG. 10 is a cross sectional view of a fifth embodiment of a vibration system.

Referring to FIG. 10, the difference between Embodiment 5 and Embodiment 1 is that the cross-section of the diaphragm body 141 in Embodiment 5 is substantially wave-like. Relative to the first connecting portion 143, the second connecting portion 145 is closer to the base 1211.

Further, the vibration assembly 13 further includes a second diaphragm portion 16 (refer to FIG. 1). The second diaphragm portion 16 is connected to an inner surface of the extending portion 1213 to enhance sound production of the vibration assembly 13, so that vibrations of the vibration assembly 13 are more linear. The second diaphragm portion 16 can be made of rigid material. The rigid material can be, but is not limited to, carbon steel, alloy steel, and non-ferrous metals. In some embodiments, the second diaphragm portion 16 is bonded on the inner surface of the extending portion 1213.

Referring to FIG. 1, the speaker 100 further includes a magnetic circuit system 30. In some embodiments, the magnetic circuit system 30 includes a second bracket 31, a U-shaped iron 33, a first washer 35, a second washer 37, and a magnet 39.

The second bracket 31 is annular. One end of the second bracket 31 connects to the block 117 on the first bracket 11, and the other end of the second bracket 31 connects to the U-shaped iron 33 to form an accommodating space 50, together with the first bracket 11 and the U-shaped iron 33. The vibration assembly 13 is partially received in the accommodating space 50. The first washer 35 is positioned in the base portion 1211 and abuts against the surface of the U-shaped iron 33 facing the first bracket 11. The second washer 37 and the magnet 39 are both positioned in the base portion 1211, and the magnet 39 is located between the first washer 35 and the second washer 37.

Figure 11:
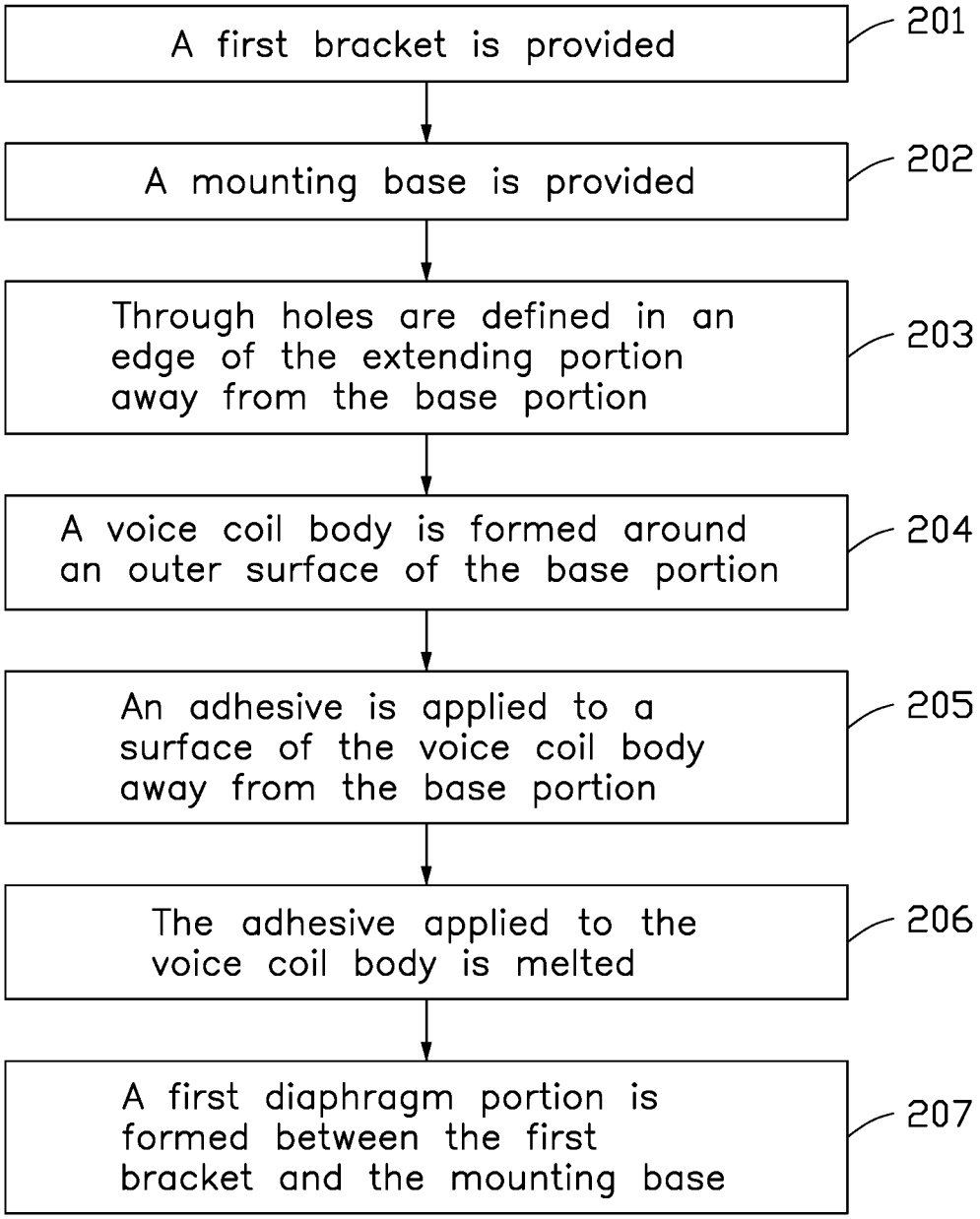
FIG. 11 is a flow chart illustrating a method for manufacturing the vibration systems of the present disclosure.

Referring to FIG. 11, a method for manufacturing the vibration system 10 is provided. The method is provided by way of example, as there are a variety of ways to carry out the method. The method described below can be carried out using the configurations illustrated in FIGS. 1-10, for example, and various elements of these figures are referenced in explaining example method. Each block shown in FIG. 11 represents one or more processes, methods, or subroutines, carried out in the example method. Furthermore, the illustrated order of blocks is illustrative only and the order of the blocks can change. Additional blocks can be added or fewer blocks may be utilized, without departing from this disclosure. The example method can begin at block 11.

At block 201, a first bracket 11 is provided.

Referring to FIGS. 3 and 4, the first bracket 11 includes an upper surface 112 and a lower surface 114. The upper surface 112 and the lower surface 114 are on opposite sides of the first bracket 11. The first bracket 11 defines a hole 111 to form an inner surface 113 on the first bracket 11. The hole 111 penetrates the upper surface 112 and the lower surface 114. The first bracket 11 can be made a material selected from plastic, metal, and combination thereof. The plastic can be, but is not limited to, ABS (Acrylonitrile Butadiene Styrene), PBT (Polybutylene Terephthalate), and PC (Polycarbonate). The metal can be, but is not limited to, aluminum, aluminum alloy, aluminum-magnesium alloy, magnesium alloy, stainless steel, titanium, and titanium alloy.

The first bracket 11 further defines at least one connecting hole 115. The connecting hole 115 is used for connecting the first bracket 11 to the electronic device. In some embodiments, the first bracket 11 defines four connecting holes 115. The four connecting holes 115 are respectively at the four corners of the first bracket 11. Each of the connection holes 115 penetrates the upper surface 112 and the lower surface 114.

Further, the first bracket 11 further includes a plurality of blocks 117 protruding from the upper surface 112 or the lower surface 114. In some embodiments, the first bracket 11 includes four blocks 117 protruding from the lower surface 114. The four blocks 117 are evenly distributed along the inner surface 113. The cross-section of the block 117 is substantially L-shaped (refer to FIG. 5).

In other embodiments, the connecting hole 115 and the block 117 can be omitted from the first bracket 11.

At block 202, a mounting base 121 is provided. In some embodiments, the mounting base 121 is made of aluminum. The mounting base 121 can be manufacturing by a stamping process.

In other embodiments, mounting base 121 can be made of a material selected from metal material, plastic, and paper. The metal can be, but is not limited to, copper, aluminum alloy, aluminum-magnesium alloy, magnesium alloy, and stainless steel. The plastic can be, but is not limited to, PI (Polyimide), and PEEK (Polyetheretherketone).

Referring to FIG. 5, the mounting base 121 includes a base portion 1211. The base portion 1211 is annular. In some embodiments, the base portion 1211 is a hollow cylinder. The base portion 1211 includes an upper edge 1212 and a lower edge 1214. The upper edge 1212 and the lower edge 1214 are on opposite sides of the base portion 1211.

Further, the mounting base 121 further includes an extending portion 1213. The extending portion 1213 extends from the upper edge 1212 along a direction away from the lower edge 1214. In some embodiments, the mounting base 121 is substantially trumpet-shaped or basin-shaped. The extending portion 1213 is recessed toward the central axis X.

At block 203, through holes 1215 are defined in an edge of the extending portion 1213 away from the base portion 1211. The through hole 1215 penetrates the extending portion 1213.

At block 204, a voice coil body 123 is formed around an outer surface of the base portion 1211. In some embodiments, the voice coil body 123 includes a plurality of copper wires wound around the outer surface of the base portion 1211.

At block 205, an adhesive is applied to a surface of the voice coil body 123 away from the base 1211.

At block 206, the adhesive applied to the voice coil body 123 is melted. Thereby the adhesive fills in gaps among the copper wires to improve the connection strength between the voice coil body 123 and the base portion 1211.

At block 207, a first diaphragm portion 14 is formed between the first bracket 11 and the mounting base 121. In some embodiments, the first bracket 11 and the mounting base 121 with the voice coil body 123 are placed in a mold, and liquid silicone rubber is injected between the first bracket 11 and the mounting base 121 to form the first diaphragm portion 14.

Referring to FIGS. 5 and 6, the first diaphragm portion 14 is between the first bracket 11 and the extending portion 1213. In some embodiments, the first diaphragm portion 14 is annular (see FIG. 3 and FIG. 4). The first diaphragm portion 14 includes a diaphragm body 141, a first connecting portion 143, and a second connecting portion 145. The diaphragm body 141 is between the first connecting portion 143 and the second connecting portion 145. The second connecting portion 145 and the diaphragm body 141 are positioned between the first connecting portion 143 and the extending portion 1213.

The first connecting portion 143 is recessed inwardly to form a first groove 1431. The first groove 1431 faces the first bracket 11. A side of the first bracket 11 adjacent to the extending portion 1213 is positioned in the first groove 1431. The first groove 1431 includes a bottom wall 1432 and two sidewalls 1434. The two sidewalls face each other. Two sidewalls 1434 are respectively at two sides of the bottom wall 1432. The inner surface 113 of the first bracket 11 abuts against the bottom wall 1432 of the first groove 1431, and the upper surface 112 and the lower surface 114 of the first bracket 11 respectively abut against two sidewalls 1434.

The second connecting portion 145 is recessed inwards to form a second groove 1451. The second groove 1451 faces the voice coil portion 12. An edge of the extending portion 1213 away from the base portion 1211 is positioned in the second groove 1451, and the through hole 1215 is filled by the second connecting portion 145.

With the above configuration, the first diaphragm portion 14 connects between the first bracket 11 and the voice coil portion 12 by injection molding process, to avoid gaps and poor acoustic performance in manual assembly of the first bracket 11, the first diaphragm portion 14, and the voice coil portion 12. The first diaphragm portion 14 further includes a diaphragm body 141 and a second connecting portion 145. The second connecting portion 145 connects to one end of the diaphragm body 141. A through hole 1215 is defined in an edge of the extending portion 1213 away from the base portion 1211. The second connecting portion 145 surrounds an edge of the base portion 1211 away from the extending portion 1213, and is for insertion into the through hole 1215. In addition, the diaphragm body 141 has a circular cross-section, an arched cross-section, or a wavelike cross-section to improve the acoustic performance of the first diaphragm portion 14. Distortion is also reduced and sensitivity improved.

It is to be understood, however, that even through numerous characteristics and advantages of the present disclosure have been set forth in the foregoing description, together with details of assembly and function, the disclosure is illustrative only, and changes may be made in details, especially in the matters of shape, size, and arrangement of parts within the principles of the disclosure to the full extent indicated by the broad general meaning of the terms in which the appended claims are expressed.

What is claimed is:

1. A vibration system, comprising:

a first bracket; and a vibration assembly comprising:

a voice coil portion comprising a mounting base and a voice coil body, wherein the mounting base comprises a base portion, the voice coil body surrounds an outer surface of the base portion, a through hole is defined at one end of the base portion away from the voice coil body, the through hole penetrates the base portion; and a first diaphragm portion comprising a first connecting portion, a second connecting portion and a diaphragm body, wherein the diaphragm body connects between the first connecting portion and the second connecting portion, the first connecting portion connects the first bracket, the second connecting portion surrounds an end of the base portion away from the voice coil body, and the second connecting portion is configured to be inserted into the through hole;

wherein the first connecting portion is recessed inward to form a first groove, the first groove faces the first bracket, a side of the first bracket closed to the base portion is positioned in the first groove;

wherein the first bracket comprises an upper surface and a lower surface opposite to the upper surface, the first bracket defines a hole to form an inner surface on the first bracket, the first groove comprises a bottom wall and two sidewalls, the two sidewalls face each other, the two sidewalls are respectively at two sides of the bottom wall, the inner surface of the first bracket abuts against the bottom wall of the first groove, and the upper surface and the lower surface of the first bracket respectively abut against the two sidewalls.

2. The vibration system of claim 1, wherein the mounting base further comprises an extending portion, the extending portion extends from an edge of the base portion away from the voice coil body along a direction from the base portion, the through hole is in an edge of the extending portion away from the base portion, the second connecting portion surrounds the edge of the extending portion away from the base portion, and the second connecting portion inserts into the through hole.

3. The vibration system of claim 2, wherein the first bracket comprises an upper surface and a lower surface opposite to the upper surface, the first bracket defines a hole to form an inner surface on the first bracket, the first groove comprises a bottom wall and two sidewalls, the two sidewalls face each other, the two sidewalls are respectively at two sides of the bottom wall, the inner surface of the first bracket abuts against the bottom wall of the first groove, and the upper surface and the lower surface of the first bracket respectively abut against the two sidewalls.

4. The vibration system of claim 2, wherein a distance between an edge of the diaphragm body near the second connecting portion and an edge of the extending portion connected to the second connecting portion is 0.02 mm to 0.6 mm.

5. The vibration system of claim 4, wherein the first bracket comprises an upper surface and a lower surface opposite to the upper surface, the first bracket defines a hole to form an inner surface on the first bracket, the first groove comprises a bottom wall and two sidewalls, the two sidewalls face each other, the two sidewalls are respectively at two sides of the bottom wall, the inner surface of the first bracket abuts against the bottom wall of the first groove, and the upper surface and the lower surface of the first bracket respectively abut against the two sidewalls.

6. The vibration system of claim 1, wherein the diaphragm body has one of a circular cross-section, an arched cross-section, and a wavy cross-section.

7. The vibration system of claim 1, wherein the first diaphragm portion is made of liquid silicone rubber.

8. A loudspeaker, comprising:

a vibration system comprising:

a first bracket; and a vibration assembly comprising:

a voice coil portion comprising a mounting base and a voice coil body, wherein the mounting base comprises a base portion, the voice coil body surrounds an outer surface of the base portion, a through hole defines in one end of the base portion away from the voice coil body, the through hole penetrates the base portion; and a first diaphragm portion comprising a first connecting portion, a second connecting portion and a diaphragm body, wherein the diaphragm body connects between the first connecting portion and the second connecting portion, the first connecting portion connects the first bracket, the second connecting portion surrounds an end of the base portion away from the voice coil body, and the second connecting portion is configured to be inserted into the through hole; and a magnetic circuit system connected to the vibration system;

wherein the first connecting portion is recessed inward to form a first groove, the first groove faces the first bracket, a side of the first bracket closed to the base portion is positioned in the first groove;

the first bracket comprises an upper surface and a lower surface opposite to the upper surface, the first bracket defines a hole to form an inner surface on the first bracket, the first groove comprises a bottom wall and two sidewalls, the two sidewalls face each other, the two sidewalls are respectively at two sides of the bottom wall, the inner surface of the first bracket abuts against the bottom wall of the first groove, and the upper surface and the lower surface of the first bracket respectively abut against the two sidewalls.

9. The loudspeaker of claim 8, wherein the mounting base further comprises an extending portion, the extending portion extends from an edge of the base portion away from the voice coil body along a direction from the base portion, the through hole is in an edge of the extending portion away from the base portion, the second connecting portion surrounds the edge of the extending portion away from the base portion, and the second connecting portion inserts into the through hole.

10. The loudspeaker of claim 9, wherein the first bracket comprises an upper surface and a lower surface opposite to the upper surface, the first bracket defines a hole to form an inner surface on the first bracket, the first groove comprises a bottom wall and two sidewalls, the two sidewalls face each other, the two sidewalls are respectively at two sides of the bottom wall, the inner surface of the first bracket abuts against the bottom wall of the first groove, and the upper surface and the lower surface of the first bracket respectively abut against the two sidewalls.

11. The loudspeaker of claim 9, wherein a distance between an edge of the diaphragm body near the second connecting portion and an edge of the extending portion connected to the second connecting portion is 0.02 mm to 0.6 mm.

12. The loudspeaker of claim 11, wherein the first bracket comprises an upper surface and a lower surface opposite to the upper surface, the first bracket defines a hole to form an inner surface on the first bracket, the first groove comprises a bottom wall and two sidewalls, the two sidewalls face each other, the two sidewalls are respectively at two sides of the bottom wall, the inner surface of the first bracket abuts against the bottom wall of the first groove, and the upper surface and the lower surface of the first bracket respectively abut against the two sidewalls.

13. The loudspeaker of claim 8, wherein the diaphragm body has one of a circular cross-section, an arched cross-section, and a wavy cross-section.

14. The loudspeaker of claim 8, wherein the first diaphragm portion is made of liquid silicone rubber.

* * * * *